US012797698B2

(12) United States Patent
Breyne

(10) Patent No.: US 12,797,698 B2
(45) Date of Patent: Nov. 17, 2026

(54) GOLF CLUB WITH INTEGRATED RETRACTABLE RETRIEVAL MECHANISM AND RELATED IMPLEMENT ADAPTATIONS

(71) Applicant: Putter Butler LLC, Charleston, SC (US)

(72) Inventor: Luke Richard Breyne, Charleston, SC (US)

(73) Assignee: Putter Butler LLC, Charleston, SC (US)

( * ) Notice: Subject to any disclaimer, the term of this patent is extended or adjusted under 35 U.S.C. 154(b) by 0 days.

(21) Appl. No.: 19/453,699

(22) Filed: Jan. 20, 2026

(65) Prior Publication Data

US 2026/0208010 A1 Jul. 23, 2026

Related U.S. Application Data

(60) Provisional application No. 63/746,542, filed on Jan. 17, 2025.

(51) Int. Cl.
*A63B 53/14* (2015.01)

(52) U.S. Cl.
CPC ..... *A63B 53/14* (2013.01)

(58) Field of Classification Search
CPC ..... A63B 47/02; A63B 53/007; A63B 53/14; A63B 53/20
See application file for complete search history.

(56) References Cited

U.S. PATENT DOCUMENTS 802,264 A * 10/1905 Brown ..... A63B 53/14 473/286
3,318,628 A * 5/1967 White ..... A63B 60/16 D21/721
5,004,240 A * 4/1991 Tsukamoto ..... A63B 60/38 473/286
5,205,598 A * 4/1993 Miller ..... A63B 57/0037 294/19.2
5,310,177 A * 5/1994 Conrad ..... A63B 57/0037 473/133
7,645,200 B2 * 1/2010 Downey ..... A63B 53/14 473/286
7,713,136 B1 * 5/2010 Colucci ..... A63B 47/02 473/286
8,632,415 B1 * 1/2014 Smith ..... A63B 47/04 473/340

(Continued)

*Primary Examiner* — Brian P Wolcott
(74) *Attorney, Agent, or Firm* — Maier & Maier, PLLC

(57) ABSTRACT

A golf club includes a club head, a shaft extending from the club head, a fitted grip coupled to an end of the shaft opposite the club head, and a retrieval mechanism integrated within the golf club. The retrieval mechanism includes a retractable gripper disposed at or near the fitted grip and movable between a retracted position and an extended position, a flexible transmission member extending internally through the shaft, a trigger mechanism positioned at or near the club head, at least one pulley configured to guide the flexible transmission member, and a plurality of coiled tension springs operatively coupled to the trigger mechanism and the flexible transmission member. Actuation of the trigger mechanism causes movement of the flexible transmission member to selectively deploy and actuate the retractable gripper to retrieve an object without requiring a user to bend.

12 Claims, 5 Drawing Sheets

(56) References Cited

U.S. PATENT DOCUMENTS

| | | | | |
|---|---|---|---|---|
| 8,858,354 | B2 * | 10/2014 | Pak | A63B 47/02 473/285 |
| 10,369,440 | B2 * | 8/2019 | Jolley | A63B 47/02 |

* cited by examiner

GOLF CLUB WITH INTEGRATED RETRACTABLE RETRIEVAL MECHANISM AND RELATED IMPLEMENT ADAPTATIONS

CROSS-REFERENCE TO RELATED APPLICATIONS

This application claims priority to U.S. Application No. 63/746,542, titled Utility Grabber Inside the Shaft of a Golf Putter to Pick Things Up, filed Jan. 17, 2025, which is hereby incorporated by reference in its entirety.

BACKGROUND

Golfers frequently need to pick up golf balls from the hole or ground, which can be inconvenient or physically challenging, especially for those with limited mobility or back problems. Various devices and methods have been developed to address this issue. For example, standalone golf ball retriever tools (e.g., telescoping poles or dedicated grabbers) can pick up balls, but carrying an extra tool is cumbersome and such retrievers have not been widely adopted by golfers. Other solutions involve attaching a retrieval aid (like suction cups or clamping mechanisms) to the end of a putter's grip; however, these attachments often interfere with the golfer's normal grip and can affect the swing or feel of the club. There have also been putter designs with ball-retrieving features built into the club head (such as scoops or cavities in the head), but these can require awkward motions to scoop up the ball and may risk damaging the edge of the golf hole during use. Additionally, solutions that rely on a friction fit or precise ball size can be unreliable if ball dimensions vary or if not aligned perfectly each time.

More broadly, golfers routinely encounter situations requiring retrieval not only of golf balls but also other items from the ground, putting greens, cups, rough terrain, water hazards, vegetation, or surrounding environments. Repeated bending can be uncomfortable, can slow pace of play, and can present challenges for individuals with limited mobility, injury, or age-related physical constraints.

Additionally, people often require similar retrieval capability in non-golf contexts. For example, a person using a walking cane may need to retrieve objects (e.g., litter or small items) from a sidewalk or ground surface without bending.

SUMMARY

According to one or more embodiments a golf club with an integrated retrieval mechanism may be provided. In at least one embodiment the golf club includes a club head, a shaft extending from the club head, a fitted grip coupled to an end of the shaft opposite the club head, and a retrieval mechanism integrated within the golf club. The retrieval mechanism includes a retractable gripper disposed at or near the fitted grip and movable between a retracted position and an extended position, a flexible transmission member extending internally through the shaft, a trigger mechanism positioned at or near the club head, at least one pulley configured to guide the flexible transmission member, and a plurality of coiled tension springs operatively coupled to the trigger mechanism and the flexible transmission member. Actuation of the trigger mechanism causes movement of the flexible transmission member to selectively deploy and actuate the retractable gripper to retrieve an object without requiring a user to bend.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1:
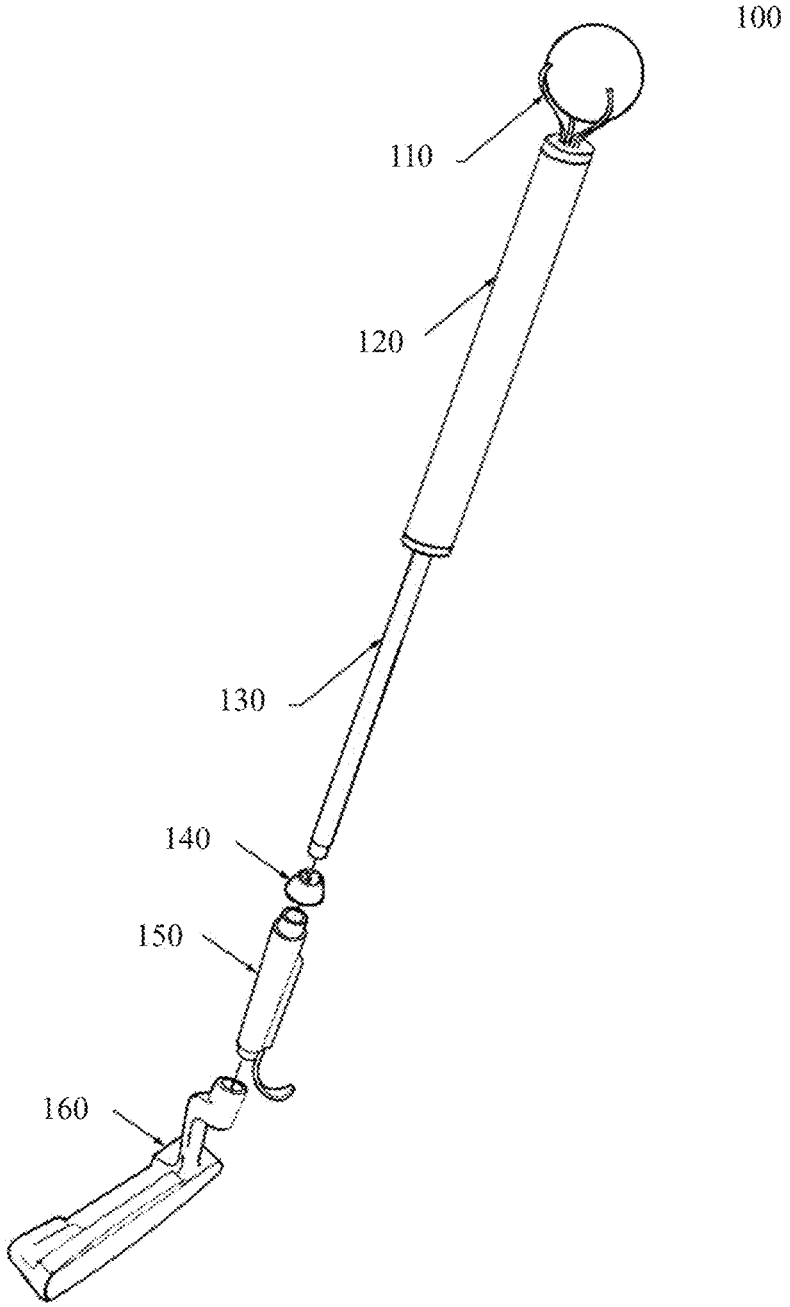
FIG. 1 illustrates an exploded perspective view of an exemplary golf putter with an integrated retractable retrieval mechanism.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to one or more exemplary embodiments a golf club having an integrated retractable retrieval mechanism may be provided. The golf club may include a club head, a shaft extending from the club head, and a handle coupled to an end of the shaft opposite the club head. A retrieval mechanism may be integrated within the golf club to enable a user to retrieve objects such as golf balls from a cup, ground surface, or other location without bending or with minimal bending.

In some cases, the retrieval mechanism may include a gripper disposed at or near the handle. The gripper may be movable between a retracted position, in which the gripper is housed within the handle, and an extended position, in which the gripper protrudes from the handle to grasp an object. A flexible transmission member may extend internally through the shaft to connect a trigger mechanism positioned at or near the club head to the gripper at the handle end. Actuation of the trigger mechanism may cause movement of the flexible transmission member, which in turn may deploy and actuate the gripper.

The retrieval mechanism may include a pulley system configured to guide the flexible transmission member and redirect force within the golf club. In some exemplary embodiments a spring system may be operatively coupled to the trigger mechanism and the flexible transmission member to maintain tension in the flexible transmission member. The spring system may include a plurality of springs having different tension ratings, which may cooperate to maintain constant cable tension in a resting position and provide controlled actuation when the trigger mechanism is actuated.

The golf club may be configured as a putter, though the retrieval mechanism may be adapted for use with other types of golf clubs. The retrieval mechanism may be designed to be compact and lightweight so as not to disturb the balance of the golf club during normal play. The gripper may be configured to retrieve golf balls, tees, gloves, markers, or other objects encountered during play.

It may be understood that in at least some embodiments the golf club may be configured such that the retrieval mechanism does not interfere with the golf clubs functionality during normal golf play, for example the retrieval mechanism does not contact the ball during a stroke and/or the retrieval mechanism remails fully retracted during normal play.

In additional aspects, the retrieval mechanism may be adapted for integration into other elongate hand-held implements. For example, the retrieval mechanism may be integrated into a walking cane to enable retrieval of objects from sidewalks or ground surfaces without bending. The walking cane adaptation may apply similar principles of trigger-and-cable actuated gripper operation, including constant tension maintenance, pulley-guided routing, and controlled actuation.

Referring to FIG. 1, an exploded perspective view of a golf putter with an integrated retractable retrieval mechanism according to an exemplary embodiment is shown and described. The golf putter may include several components arranged along a vertical axis to illustrate the relationship and assembly order of the various elements.

At an uppermost portion of the assembly, a retractable gripper 110 is shown in an extended position grasping a golf ball. The retractable gripper 110 may include a plurality of prongs arranged radially and configured to surround and secure a golf ball during retrieval operations. In some cases, the retractable gripper 110 may include four prongs, though other configurations may be employed.

Below the retractable gripper 110, a fitted grip 120 is depicted as an elongated cylindrical component. The fitted grip 120 may house the retractable gripper 110 when the retrieval mechanism is in a resting state. The fitted grip 120 may provide a comfortable gripping surface for a user during normal putting operations.

Extending downward from the fitted grip 120 is a shaft 130 that forms a main structural element connecting the fitted grip 120 to a club head 160. The shaft 130 may be hollow to accommodate internal cable routing for the retrieval mechanism. In some embodiments, the shaft 130 may be constructed from carbon fiber, stainless steel, or other materials.

A cap 140 may be positioned along the shaft 130 and may provide a transition point and protective seal between the shaft 130 and a mechanism module 150 below. The cap 140 may be constructed from, for example, neoprene or other suitable materials.

The mechanism module 150 is shown as a separate component that may house a trigger mechanism, spring system, and pulley arrangement. The module 150 may be positioned adjacent to a hosel region and may contain actuation components that control extension and retraction of the retractable gripper 110 through an internal cable system.

At a bottom of the assembly, the club head 160 is depicted. The club head 160 may be configured as a conventional putter head design that attaches to the shaft 130 and the module 150. The club head 160 may maintain a standard configuration suitable for normal putting strokes, such as a blade or mallet design.

Figure 2:
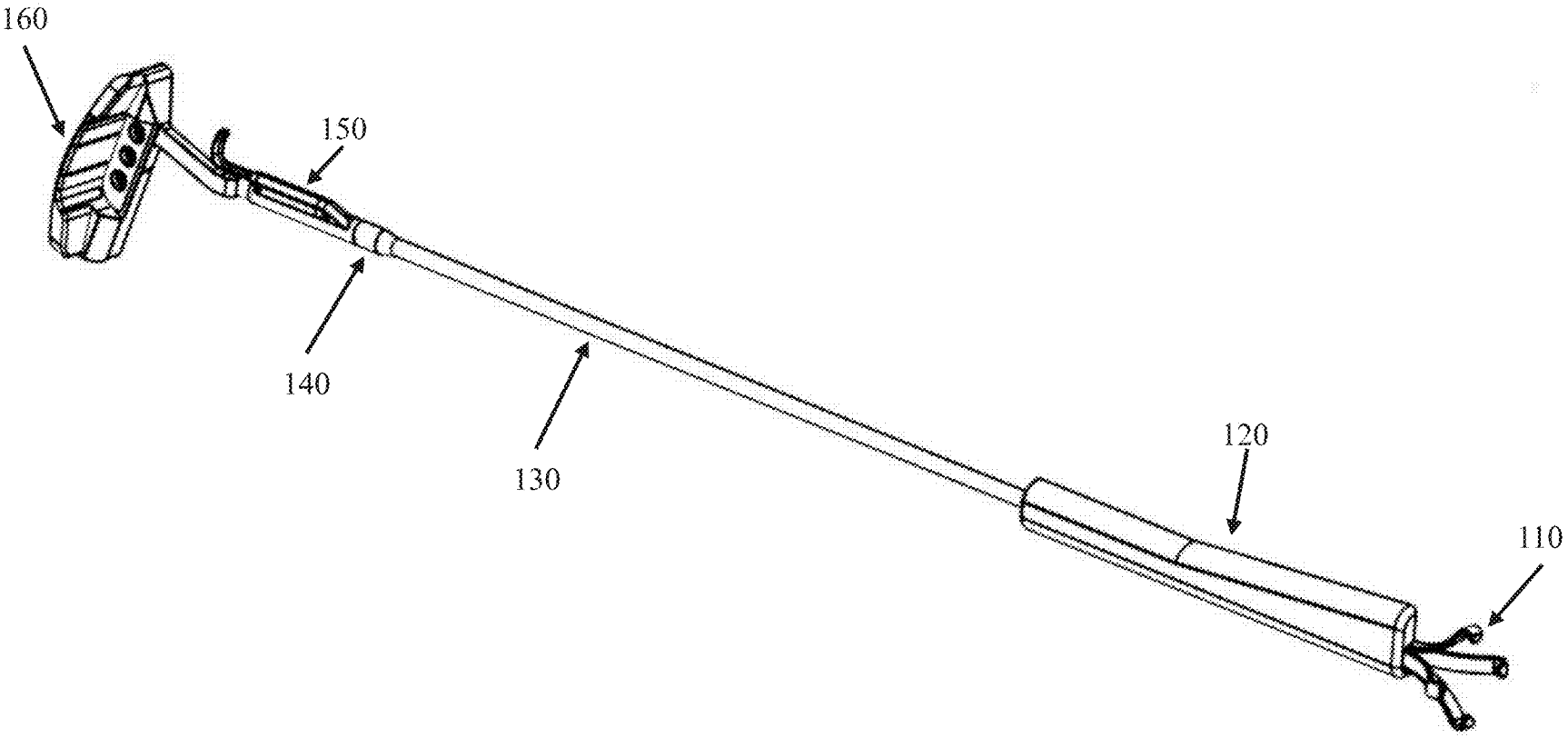
FIG. 2 illustrates a perspective overview of another exemplary putter assembly.

Referring to FIG. 2, a perspective overview of the putter assembly according to an exemplary embodiment may be shown and described. The perspective view illustrates the golf putter with the integrated retrieval mechanism in an assembled configuration. The putter assembly may include the club head 160 at a lower end, with the shaft 130 extending upward to the fitted grip 120 at an upper end. The module 150 may be positioned adjacent to a hosel region where the shaft 130 connects to the club head 160.

The perspective view of FIG. 2 may be understood to demonstrate how the various components of the retrieval mechanism may be integrated into the golf putter while maintaining an external appearance consistent with a conventional putter design. The fitted grip 120 may house the retractable gripper when the retrieval mechanism is in a resting state, and the gripper may extend from the fitted grip when actuated via the trigger mechanism housed within the module.

In some cases, the retrieval mechanism may be adapted for integration into other elongate hand-held implements beyond golf clubs. For example, the retrieval mechanism may be integrated into a walking cane. In such an adaptation, a trigger may be positioned near a cane handle, and a cable may be routed through a cane shaft to a gripper located at a distal end of the walking cane. The walking cane adaptation may employ a spring-and-cable architecture similar to that described for the golf putter, enabling retrieval of objects from sidewalks or ground surfaces without bending. The trigger-and-cable actuated gripper system in the walking cane may apply principles of constant tension maintenance, pulley-guided routing, and controlled actuation consistent with the golf club embodiment.

When a user desires to retrieve an object such as a golf ball, the user may actuate a trigger mechanism housed within a module 150 positioned adjacent to a hosel region of the golf club. Actuation of the trigger mechanism initiates a sequence of mechanical operations that transmit force through the golf club to deploy and actuate a retractable gripper 110 at a handle end of the golf club.

Upon actuation of the trigger mechanism, a first spring within the module 150 may contract while a second spring within the module 150 may stretch. The first spring may bias the trigger mechanism to a default resting position when the trigger mechanism is not actuated. The second spring may have a higher tension rating than the first spring. The differential tension between the first spring and the second spring may cause a flexible transmission member to translate through the module 150 and through a shaft 130 extending from the module 150 toward a fitted grip 120 at an opposite end of the golf club.

The flexible transmission member may be routed through a dual-pulley system within the module 150. A first pulley may guide the flexible transmission member along a path within the module 150 toward the shaft 130. A second pulley may reverse the direction of force applied to the flexible transmission member such that trigger motion is translated into controlled cable movement aligned with the shaft 130. The force direction reversal provided by the second pulley may reduce binding of the flexible transmission member within the module 150 and may improve reliability of force transmission during actuation.

As the flexible transmission member translates through the shaft 130, the flexible transmission member may pass through a cap 140 positioned along the shaft 130 that provides a transition point between the shaft 130 and the module 150. The cap 140 may maintain a seal around the flexible transmission member while permitting movement of the flexible transmission member during actuation.

Translation of the flexible transmission member through the shaft 130 may cause the retractable gripper 110 to move from a retracted position to an extended position. In the retracted position, prongs of the retractable gripper 110 may be housed within the fitted grip 120. As the flexible transmission member translates in response to trigger actuation, the prongs of the retractable gripper 110 may extend outward from the fitted grip 120 and may open to a configuration suitable for surrounding an object.

The dual-spring system may enable graduated control of gripper motion based on trigger pressure applied by the user. A user may apply variable pressure to the trigger mechanism to achieve variable extension and opening of the retractable gripper 110. Graduated control may permit a user to modulate the position and opening of the retractable gripper 110 for different retrieval scenarios.

When the user releases the trigger mechanism, the higher tension of the second spring may overcome the tension of the first spring, causing the flexible transmission member to translate in a reverse direction through the shaft 130. Reverse translation of the flexible transmission member may cause the prongs of the retractable gripper 110 to close around an object positioned within the prongs and may draw the retractable gripper 110 toward the retracted position within the fitted grip 120.

The dual-spring system may maintain constant tension in the flexible transmission member when the trigger mechanism is in a resting position. Constant cable tension may prevent slack in the flexible transmission member, which may contribute to repeatable operation of the retrieval mechanism across multiple actuation cycles.

In an example use case, a golfer may retrieve a golf ball from a cup after completing a putt. The golfer may invert the golf club such that the fitted grip 120 is oriented downward toward the cup. The golfer may position the fitted grip 120 over the golf ball resting within the cup.

The golfer may actuate the trigger mechanism within the module 150 to deploy the retractable gripper 110 from the fitted grip 120. Upon actuation, the prongs of the retractable gripper 110 may extend from the fitted grip 120 and may open to surround the golf ball within the cup.

The golfer may release or modulate pressure on the trigger mechanism to cause the prongs of the retractable gripper 110 to close around the golf ball. The closing action of the prongs may secure the golf ball within the retractable gripper 110. The golfer may then lift the golf club with the golf ball secured within the retractable gripper 110, removing the golf ball from the cup without bending.

After lifting the golf ball from the cup, the golfer may actuate the trigger mechanism again to open the prongs of the retractable gripper 110 and release the golf ball into the golfer's hand or another location. Upon release of the trigger mechanism, the retractable gripper 110 may return to the retracted position within the fitted grip 120, and the retrieval mechanism may return to a resting state ready for subsequent retrieval operations.

The retrieval mechanism may permit retrieval of objects other than golf balls using a similar sequence of operations. A user may position the fitted grip 120 over a tee, glove, marker, or other object, actuate the trigger mechanism to deploy and open the retractable gripper 110, release or modulate the trigger mechanism to close the retractable gripper 110 around the object, and lift the golf club to retrieve the object. The radial arrangement of the prongs and the curved terminal ends of the retractable gripper 110 may accommodate objects of varying sizes within a range suitable for typical golf accessories.

A club head 160 coupled to the module 150 and the shaft 130 may maintain standard dimensions and weight characteristics during retrieval operations. The retrieval mechanism may be configured such that actuation of the trigger mechanism and deployment of the retractable gripper 110 do not substantially alter the structural integrity or balance of the golf club. The golfer may perform retrieval operations and subsequently resume normal putting operations without adjustment to grip position or swing technique.

Figure 3:
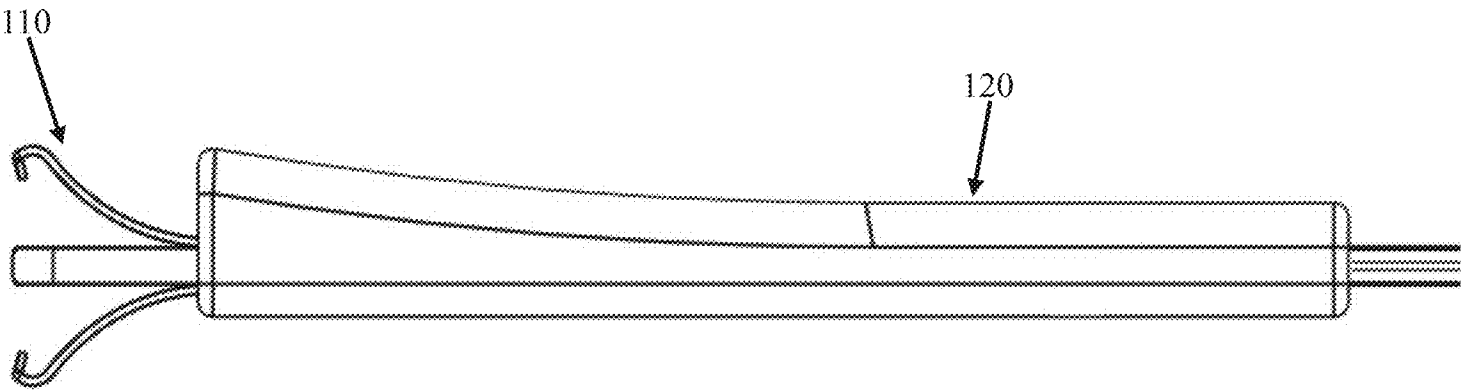
FIG. 3 illustrates a side view of an exemplary golf club shaft assembly with a gripper in a deployed configuration.

Referring to FIG. 3, a side view of the golf club shaft assembly with the integrated retrieval mechanism in a deployed configuration is shown. A retractable gripper 110 is depicted at one end of the assembly in an extended position, with multiple curved prongs protruding outward from the fitted grip 120.

The retractable gripper 110 may include a plurality of prongs arranged in a radial configuration. In some cases, the retractable gripper 110 may include four prongs, though other prong quantities may be employed. The prongs may be configured to surround and grasp a golf ball when the retractable gripper 110 is in the extended position. As shown in FIG. 3, the prongs may feature hooked or curved terminal ends designed to facilitate grasping of objects.

The prongs of the retractable gripper 110 may be constructed from spring steel, reinforced polymer, or other suitable materials. Spring steel may provide resilience and durability for repeated grasping operations. Reinforced polymer may offer a lightweight alternative while maintaining sufficient strength to secure objects during retrieval.

With continued reference to FIG. 3, the retractable gripper 110 may be configured to retrieve various objects encountered during golf play. In addition to golf balls, the retractable gripper 110 may grasp tees, gloves, markers, or similar items. The radial arrangement of the prongs and the curved terminal ends may accommodate objects of varying sizes and shapes within a range suitable for typical golf accessories.

A fitted grip 120 may be configured to house the retractable gripper 110 when the retrieval mechanism is in a retracted position. The fitted grip 120 may be an elongated cylindrical component that provides a comfortable gripping surface for a user during normal putting operations. In some cases, the fitted grip 120 may have a dark exterior surface or other finish suitable for maintaining a secure hold during a putting stroke.

The fitted grip 120 may include an internal cavity sized to accommodate the retractable gripper 110 and associated components when the retractable gripper 110 is drawn inward to the retracted position. The internal cavity may be configured such that the prongs of the retractable gripper 110 do not interfere with the external gripping surface of the fitted grip 120. In some cases, the fitted grip 120 may include internal guides or channels that direct the prongs of the retractable gripper 110 into proper alignment during retraction.

The fitted grip 120 may be constructed from rubber, synthetic polymer, leather, or other materials commonly used for golf club grips. The exterior surface of the fitted grip 120 may include texturing, patterns, or other features to enhance grip during normal play. In some cases, the fitted grip 120 may have a tapered profile or contoured shape to accommodate different hand sizes and grip preferences.

The fitted grip 120 may include an opening or aperture at a distal end through which the retractable gripper 110 may extend when actuated. The opening may be sized to permit passage of the prongs of the retractable gripper 110 while maintaining a seal or closure when the retractable gripper 110 is in the retracted position. In some cases, a flexible membrane, flap, or other closure element may cover the opening when the retractable gripper 110 is retracted.

The fitted grip 120 may be coupled to the shaft 130 through a press fit, adhesive bond, threaded connection, or other attachment method. The connection between the fitted grip 120 and the shaft 130 may permit routing of a flexible transmission member through the interior of the fitted grip 120 to connect with the retractable gripper 110. In some cases, the fitted grip 120 may be removable to permit maintenance or replacement of internal components of the retrieval mechanism.

A shaft 130 may be configured as a hollow elongated member that connects the fitted grip 120 to the club head 160. The shaft 130 may provide structural support for the golf club while accommodating internal components of the retrieval mechanism within the hollow interior.

The shaft 130 may be constructed from stainless steel, carbon fiber composite, graphite, or other materials. Stainless steel may provide durability and corrosion resistance. Carbon fiber composite may offer a lightweight construction while maintaining structural rigidity. Graphite may provide a balance of weight and feel characteristics. The material selection for the shaft 130 may be chosen to maintain a standard feel during normal putting operations, such that the integrated retrieval mechanism does not substantially alter the swing characteristics of the golf club.

The hollow interior of the shaft 130 may accommodate cable routing for the retrieval mechanism. A flexible transmission member may extend through the hollow interior of the shaft 130 to connect the trigger mechanism positioned at or near the club head 160 to the retractable gripper 110 at the fitted grip 120 end. The hollow interior may be sized to permit passage of the flexible transmission member while maintaining sufficient wall thickness for structural integrity.

In some cases, the shaft 130 may include internal liners or guides positioned within the hollow interior. The internal liners or guides may reduce friction between the flexible transmission member and the interior surface of the shaft 130 during cable operation. The internal liners or guides may also reduce noise generated by movement of the flexible transmission member within the shaft 130. In some cases, the internal liners or guides may reduce wear on the flexible transmission member and the interior surface of the shaft 130 over repeated actuation cycles.

The internal liners or guides may be constructed from low-friction materials such as polymer, nylon, or other suitable materials. In some cases, the internal liners or guides may be positioned at intervals along the length of the shaft 130 to support the flexible transmission member at multiple points. The internal liners or guides may include apertures or channels through which the flexible transmission member passes.

A cap 140 may be positioned along the shaft 130 and may provide a transition point between the shaft 130 and the module 150. The cap 140 may function as a protective seal that shields internal mechanism components from environmental exposure.

The cap 140 may be constructed from neoprene, rubber, silicone, or other elastomeric materials. Neoprene may provide resistance to moisture, temperature variations, and wear. Rubber or silicone may offer flexibility while maintaining a secure seal against the shaft 130 and the module 150.

The cap 140 may be configured to prevent ingress of dirt, debris, moisture, or other contaminants into the interior of the shaft 130 where the flexible transmission member and other internal components are housed. In some cases, the cap 140 may include a compression fit or interference fit that creates a seal against adjacent components.

The cap 140 may accommodate passage of the flexible transmission member between the shaft 130 and the module 150. In some cases, the cap 140 may include an aperture or channel through which the flexible transmission member extends. The aperture or channel may be sized to permit movement of the flexible transmission member during actuation while maintaining a seal around the flexible transmission member.

In some cases, the cap 140 may provide vibration dampening between the shaft 130 and the module 150. The elastomeric material of the cap 140 may absorb vibrations generated during normal play or during actuation of the retrieval mechanism. Vibration dampening may reduce noise and may contribute to a consistent feel during putting operations.

The cap 140 may be removable to permit access to internal components for maintenance, repair, or replacement. In some cases, the cap 140 may be secured to the shaft 130 or the module 150 through a friction fit, adhesive bond, or mechanical fastener. A removable configuration may facilitate inspection of the flexible transmission member and other internal components housed within the shaft 130.

A module 150 may house a trigger mechanism, a spring system, and a pulley arrangement that together control actuation of the retrieval mechanism. The module 150 may be positioned adjacent to a hosel region of the golf club and may contain components that transmit force from a user-actuated trigger to the retractable gripper through a flexible transmission member.

The trigger mechanism within the module 150 may include a trigger configured as a discreet lever or button accessible to a user. The trigger may be linearly mounted to permit movement along a linear path when pressed and return along the same path when released. In some cases, the trigger may be pivotally mounted to permit rotational movement when actuated and return to a resting position when released. The trigger may be positioned such that a user may actuate the trigger without substantially altering grip position during retrieval operations.

It may be understood that in other embodiments other trigger mechanisms may be used, for example but note limited to thumb-actuated triggers, index-finger-actuated triggers, pressure-sensitive triggers, and/or any other trigger mechanism known in the art.

The module 150 may include a flexible cable extending through the module 150 and connecting to the flexible transmission member that runs through the shaft. The flexible cable may comprise braided wire rope, which may provide tensile strength and flexibility for repeated actuation cycles. In some cases, the flexible cable may comprise a flexible push/pull cable configured to transmit both tensile and compressive forces. Other suitable transmission members may be employed depending on the force transmission requirements of the retrieval mechanism.

The flexible cable may be coated to reduce friction between the flexible cable and internal surfaces of the module 150 and the shaft. The coating may also reduce fraying of the flexible cable over repeated actuation cycles. In some cases, the coating may comprise a polymer material, a lubricant-impregnated layer, or other friction-reducing material.

The module 150 may include a dual-spring system comprising a first spring and a second spring. The second spring may have a higher tension rating than the first spring. The dual-spring configuration may maintain constant cable tension when the trigger is in a resting position. When the trigger is actuated, the second spring may stretch while the first spring contracts, causing the flexible cable to translate through the module 150 and the shaft to deploy and actuate the retractable gripper. When the trigger is released, the higher tension of the second spring may return the mechanism to the resting state by overcoming the tension of the first spring.

The springs within the module 150 may be constructed from stainless steel or other corrosion-resistant metals. Stainless steel may provide durability and resistance to environmental conditions encountered during golf play. Corrosion-resistant metals may extend the operational lifespan of the spring system by reducing degradation from moisture exposure.

The module 150 may include a dual-pulley system comprising a first pulley and a second pulley. The first pulley may be configured to guide the flexible cable along a path within the module 150. The second pulley may be configured to reverse the direction of force applied to the flexible cable. The force direction reversal provided by the second pulley may translate trigger motion into controlled cable movement aligned with the shaft, which may reduce binding and improve reliability of the retrieval mechanism.

The pulleys within the module 150 may be constructed from metal or wear-resistant polymer. Metal pulleys may provide durability for repeated cable routing operations. Wear-resistant polymer pulleys may offer a lightweight alternative while maintaining sufficient strength and wear characteristics. In some cases, the pulleys may include low-friction surfaces or bearings to reduce resistance during cable movement. Low-friction surfaces or bearings may contribute to smooth operation of the retrieval mechanism and may reduce wear on the flexible cable.

The module 150 may route the flexible cable over a larger pulley to reduce curvature of the flexible cable during operation. Reduced curvature may decrease stress on the flexible cable at the pulley contact point, which may improve durability of the flexible cable over repeated actuation cycles. In some cases, the pulley diameter may be selected to balance durability considerations with space constraints within the module 150.

The trigger mechanism within the module 150 may enable graduated control of claw motion based on trigger pressure. A user may apply variable pressure to the trigger to achieve variable gripping force at the retractable gripper. Graduated control may permit a user to modulate the opening and closing of the retractable gripper for different retrieval scenarios, such as grasping objects of different sizes or releasing objects with controlled force.

The module 150 may include internal guides configured to prevent rattling of components during use. The internal guides may secure the flexible cable, springs, pulleys, and other components within the module 150 to reduce movement and noise during normal play and during actuation of the retrieval mechanism. In some cases, the internal guides may comprise polymer inserts, foam padding, or other dampening materials positioned within the module 150.

Weight distribution of the module 150 may be managed using lightweight materials to preserve conventional swing feel of the golf club. The module 150 may be constructed from aluminum, titanium, polymer composites, or other lightweight materials. Component selection within the module 150 may balance structural requirements with weight considerations such that the integrated retrieval mechanism does not substantially alter the balance or swing characteristics of the golf club during normal putting operations.

A club head 160 may be coupled to the module 150 and the shaft 130 to form a complete golf club assembly. The club head 160 may include a club head configured for putting operations and a hosel region that provides a junction between the club head and the shaft 130.

The club head of the club head 160 may be configured in various standard putter head designs. In some cases, the club head may be configured as a blade design, which may feature a relatively thin, elongated head profile. In some cases, the club head may be configured as a mallet design, which may feature a larger, more rounded head profile with increased mass distributed toward a rear portion of the head. Other standard putter head configurations may be employed with the retrieval mechanism without departing from the scope of the present disclosure.

The hosel region of the club head 160 may provide a connection point between the club head and the shaft 130. The hosel region may be configured to accommodate the module 150 such that the trigger mechanism housed within the module 150 is accessible to a user during retrieval operations. In some cases, the hosel region may include an offset configuration, a straight configuration, or other hosel geometries compatible with standard putter designs.

The club head 160 may be constructed from stainless steel, aluminum, zinc alloy, brass, or other materials commonly used for putter head construction. Material selection for the club head 160 may be chosen to provide desired weight distribution, feel characteristics, and durability for putting operations. In some cases, the club head 160 may include insert materials on a striking face, such as polymer inserts or metal alloy inserts, to modify feel and sound characteristics during ball contact.

The club head 160 may maintain standard dimensions and weight characteristics such that the integrated retrieval mechanism does not substantially alter the performance of the golf club during normal putting operations. The club head of the club head 160 may conform to equipment standards established by golf governing bodies, permitting use of the golf club in competitive play where such standards apply.

Figure 4:
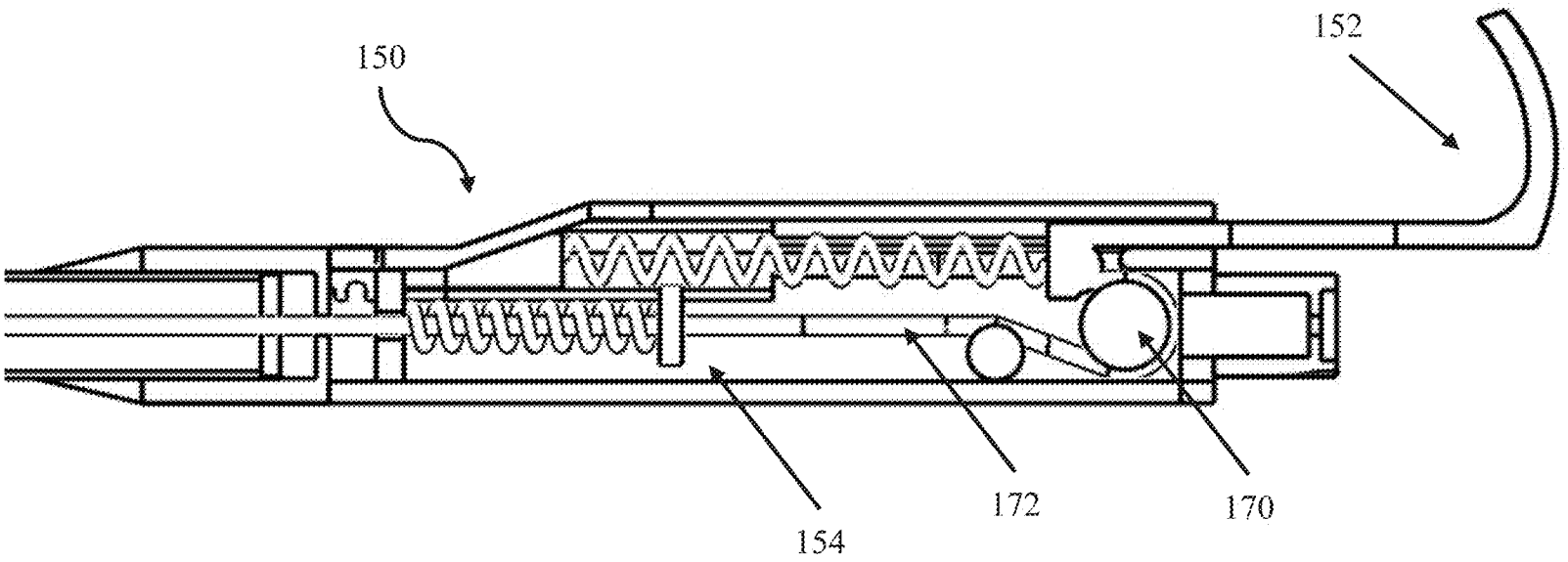
FIG. 4 illustrates a side cross-sectional view of a hosel region of an exemplary golf club showing a gripper assembly in a retracted position.

Referring to FIG. 4, a side cross-sectional view of the hosel region of the golf club is shown with the gripper assembly in a retracted position. The cross-section reveals internal components housed within the handle portion of the putter.

A retractable gripper 110 is depicted in a closed and retracted configuration where prongs of the retractable gripper 110 are drawn inward and housed within a fitted grip 120. In the retracted position, the prongs of the retractable gripper 110 may be positioned such that the prongs do not protrude beyond an exterior surface of the fitted grip 120. The retracted configuration may permit normal putting operations without interference from the retrieval mechanism.

As shown in FIG. 4, the internal mechanism includes coiled tension springs 154 positioned in a stacked arrangement within the module 150. The coiled tension springs 154 may comprise two helical spring elements, with one spring positioned above the other within an internal cavity of the module 150. The coiled tension springs 154 may include a first spring and a second spring, wherein the first spring may contract while the second spring may stretch during actuation of the trigger mechanism. The first spring may bias the trigger mechanism to a default resting position when the trigger mechanism is not actuated. The coiled tension springs 154 may be operatively connected to the retractable gripper 110 and may work in conjunction with a cable system to control extension and retraction of the retractable gripper 110. The helical configuration of the coiled tension springs 154 may provide consistent spring force throughout the range of motion of the retrieval mechanism. The stacked arrangement of the coiled tension springs 154 may permit compact packaging of the spring components within the available space of the module 150 while providing sufficient spring force for reliable gripper actuation. The internal mechanism further includes at least one pulley 170 and a flexible transmission member 172.

The handle cavity of the fitted grip 120 may be sized to accommodate the retractable gripper 110, the coiled tension springs, and associated actuation components when the retrieval mechanism is in a resting state. The handle cavity may include internal surfaces configured to guide the prongs of the retractable gripper 110 into proper alignment during retraction. In some cases, the internal surfaces may include channels or recesses that receive the prongs when the retractable gripper 110 is drawn inward.

With continued reference to FIG. 4, a gripper lever 152 is visible near a right side of the assembly as a curved element extending upward from the module 150. The gripper lever 152 may have a curved profile that facilitates mechanical advantage during actuation of the gripper assembly. The gripper lever 152 may interface with the retractable gripper 110 through a flexible cable running through the shaft to facilitate extension and retraction of the prongs during retrieval operations. In some cases, the gripper lever 152 may be pivotally mounted within the module 150 such that movement of the flexible cable causes corresponding movement of the gripper lever 152, which in turn actuates the retractable gripper 110.

The coiled tension springs within the fitted grip 120 may cooperate with springs housed within the module to maintain constant cable tension throughout the retrieval mechanism. When the trigger mechanism is in a resting position, the springs may bias the retractable gripper 110 toward the retracted position such that the prongs are housed within the fitted grip 120. The spring arrangement may provide a return force that draws the retractable gripper 110 inward when the trigger is released after a retrieval operation.

A curved element at an upper right portion of FIG. 4 represents part of an external handle or grip surface of the fitted grip 120. The external handle or grip surface may provide a comfortable gripping area for a user during normal putting operations. The cross-sectional view illustrates how the retrieval mechanism components are contained within the fitted grip 120 while maintaining an external profile suitable for standard grip characteristics.

The arrangement shown in FIG. 4 demonstrates how the retrieval mechanism may be compactly integrated within the fitted grip 120 while maintaining sufficient space for the springs and cable routing for controlled gripper operation. The internal components may be positioned such that weight distribution within the fitted grip 120 does not substantially alter the balance of the golf club during normal play.

Figure 5:
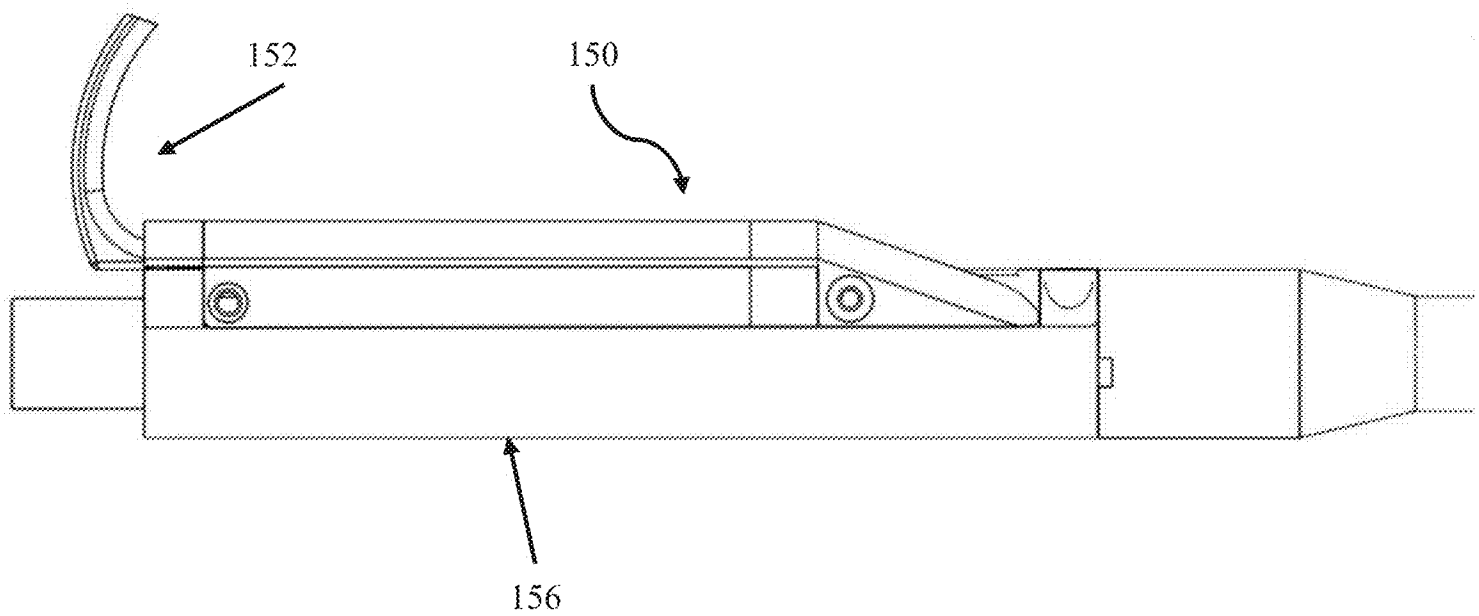
FIG. 5 illustrates a side orthogonal view of an exemplary golf club with an integrated retractable retrieval mechanism, according to aspects of the present disclosure.

Referring to FIG. 5, a side orthogonal view of the golf club with the integrated retractable retrieval mechanism is shown. The side view illustrates the linear arrangement of mechanism components along the length of the golf club and demonstrates how the various assemblies connect to form a complete retrieval system.

A club head is positioned at a left end of the assembly as shown in FIG. 5. The club head may be configured for putting operations. A hosel area provides a junction between the club head and a shaft extending horizontally from the club head.

A module 150 is positioned adjacent to the hosel area of the club head 160. The module 150 houses a trigger mechanism within a trigger housing 156, which is shown as a rectangular section extending downward from a main body of the module 150 near the junction between the club head 160 and the shaft 130. The trigger housing 156 may contain the trigger mechanism that a user actuates to control extension and retraction of the gripper assembly. The trigger housing 156 may be configured to protect internal trigger components from environmental exposure while permitting user access to the trigger. In some cases, the trigger housing 156 may include an opening or aperture through which a trigger lever or button protrudes for user actuation. The trigger mechanism within the trigger housing 156 may be accessible to a user for actuation during retrieval operations. At an opposite end of the module 150, a gripper lever 152 is visible as a curved element extending upward from the assembly. The gripper lever 152 may have a curved profile configured to interface with the gripper assembly and facilitate actuation during retrieval operations. The spatial relationship between the trigger housing 156 and the gripper lever 152 along the length of the module 150 may define the cable routing path for the flexible transmission member. The module 150 contains actuation components including springs and pulleys that control extension and retraction of a gripper assembly through an internal cable system.

With continued reference to FIG. 5, a shaft extends horizontally from the module 150 toward a handle end of the golf club. The shaft may be hollow to accommodate internal components of the retrieval mechanism, including a flexible transmission member that connects the trigger mechanism within the module 150 to the gripper assembly at the handle end. The shaft transitions to a tapered section toward a right end of the assembly as depicted in FIG. 5.

Two circular elements are visible along an upper portion of the assembly in FIG. 5. The two circular elements correspond to pulley components that guide the flexible transmission member internally through the shaft. The pulley components may redirect force transmitted through the flexible transmission member and may reduce friction during cable operation. The positioning of the pulley components along the assembly may support the flexible transmission member at multiple points along the cable routing path.

A retractable gripper 110 is shown at the handle end of the golf club in a retracted position. A curved prong element of the retractable gripper 110 is visible extending upward from the handle area. In the retracted position, the retractable gripper 110 may be housed within a handle portion of the golf club such that the retractable gripper 110 does not interfere with normal putting operations.

The side view of FIG. 5 reveals the linear arrangement of internal mechanism components along the length of the assembly. The trigger mechanism within the module 150 near the club head connects through the shaft 130 to the retractable gripper 110 at the handle end via the flexible transmission member. Actuation of the trigger mechanism may cause movement of the flexible transmission member through the shaft 130, which in turn may deploy and actuate the retractable gripper 110 for object retrieval.

As further shown in FIG. 5, the overall design of the golf club maintains a profile consistent with a standard golf putter. The retrieval mechanism components may be incorporated in a manner that does not substantially alter the external appearance of the golf club. The linear arrangement of the module 150, the shaft 130, and the retractable gripper 110 may permit efficient force transmission from the trigger mechanism to the gripper assembly while maintaining structural integrity and balance characteristics suitable for normal putting operations.

Referring generally to the embodiments described above, it may be understood that the embodiments may be realized through a plurality of manufacturing methodologies. Manufacturing methods may include, but are not limited to, injection-molded modules, CNC-machines housing, original manufacturing of the golf club, retrofitting existing golf clubs, and/or retrofit kits to modify an existing club.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A golf club comprising:

a club head;

a shaft extending from the club head;

a fitted grip coupled to an end of the shaft opposite the club head;

a retrieval mechanism integrated within the golf club, the retrieval mechanism including:

a retractable gripper disposed at the fitted grip and movable between a retracted position and an extended position;

a flexible transmission member extending internally through the shaft;

a trigger mechanism positioned at the club head;

at least one pulley configured to guide the flexible transmission member; and a plurality of coiled tension springs operatively coupled to the trigger mechanism and the flexible transmission member;

wherein actuation of the trigger mechanism causes movement of the flexible transmission member to selectively deploy and actuate the retractable gripper to retrieve an object without requiring a user to bend; and wherein the plurality of coiled tension springs includes a first spring and a second spring, the second spring having a higher tension rating than the first spring.

2. The golf club of claim 1, wherein the retractable gripper comprises a plurality of prongs configured to grasp a golf ball.

3. The golf club of claim 2, wherein the retractable gripper comprises four prongs arranged radially.

4. The golf club of claim 1, wherein the trigger mechanism is housed within a module positioned adjacent a hosel region of the golf club.

5. The golf club of claim 1, wherein the flexible transmission member comprises a braided wire rope or a flexible push/pull cable.

6. The golf club of claim 1, wherein the at least one pulley includes a first pulley and a second pulley configured to reverse a direction of force applied to the flexible transmission member.

7. The golf club of claim 1, wherein the first spring and the second spring cooperate to maintain constant cable tension in the flexible transmission member when the trigger mechanism is in a resting position.

8. The golf club of claim 1, wherein the retractable gripper is housed within the fitted grip when the retractable gripper is in the retracted position.

9. The golf club of claim 8, wherein the fitted grip is sized to accommodate the retractable gripper when the retractable gripper is in the retracted position.

10. The golf club of claim 1, wherein the retractable gripper is configured to retrieve a golf ball, a tee, a glove, or a marker.

11. The golf club of claim 1, wherein the shaft is hollow to accommodate internal routing of the flexible transmission member.

12. The golf club of claim 11, wherein the shaft is positioned within the shaft to reduce friction between the flexible transmission member and an interior surface of the shaft.

* * * * *